United States Patent [19]

Muller

[11] Patent Number: 4,777,686

[45] Date of Patent: Oct. 18, 1988

[54] METHOD OF CONSTRUCTING A CABLE STAYED SEGMENTAL BRIDGE

[75] Inventor: Jean M. Muller, Tallahassee, Fla.

[73] Assignee: Figg and Muller Engineers, Inc., Tallahassee, Fla.

[21] Appl. No.: 110,536

[22] Filed: Oct. 20, 1987

Related U.S. Application Data

[63] Continuation of Ser. No. 823,660, Jan. 29, 1986, abandoned, which is a continuation-in-part of Ser. No. 803,669, Dec. 2, 1985, abandoned.

[51] Int. Cl.[4] ..... E01D 21/04

[52] U.S. Cl. ..... 14/1; 14/18

[58] Field of Search ..... 14/1, 17–19, 14/20, 23, 77

[56] References Cited

U.S. PATENT DOCUMENTS 3,673,624 7/1972 Finsterwalder et al. ..... 14/19

3,989,218 11/1976 Muller ..... 14/1 X 4,513,465 4/1985 Schambeck ..... 14/17

FOREIGN PATENT DOCUMENTS 1235973 3/1967 Fed. Rep. of Germany ..... 14/18

2361182 6/1974 Fed. Rep. of Germany ..... 14/1

OTHER PUBLICATIONS

Figg, Jr., Eugene C., "You Can't Get There From Here?", *Concrete Specifier* 4–1980.

*Primary Examiner*—Jerome W. Massie

*Assistant Examiner*—Matthew Smith

*Attorney, Agent, or Firm*—Watson, Cole, Grindle & Watson

[57] ABSTRACT

Precast concrete hollow box girders of a two-wide cable stayed segmental bridge are provided as having inner side slabs of connected girder pairs acting to transfer loads of the box girder pairs to a central location thereof at which they are supported by cable stays.

8 Claims, 3 Drawing Sheets

METHOD OF CONSTRUCTING A CABLE STAYED SEGMENTAL BRIDGE

RELATED APPLICATION

This application is a continuation of application Ser. No. 823,660, filed Jan. 29, 1986 now abandoned, which is a continuation-in-part of U.S. Ser. No. 803,669, filed Dec. 2, 1985 and entitled "Method Of Constructing The Approach And Main Spans Of A Cable Stayed Segmental Bridge" also abandoned.

BACKGROUND OF THE INVENTION

This invention relates generally to a bridge construction for a cable stayed segmental bridge in which modules forming deck segments of precast concrete hollow box girders are progressively placed and interconnected to form a bridge having approach spans and an intermediate main span which is constructed as a continuation of the approach spans utilizing essentially the same deck segments and avoiding the need for specialized construction equipment.

One of the features of the invention of the aforementioned application concerns the provision of transverse load carrying members which may be in the form of delta frames for transferring static and dynamic loads of the two-wide box girder bridge to the central plane of support provided by the cable stays. An alternative to such transverse load carrying members has now been devised for simplifying the manner in which loads are transferred to a central location between the box girder pairs.

And, another feature of the invention of the aforementioned application concerns erecting segmental pylons as the cable stays are successively draped over the tops of successively placed pylon segments. An alternative to this pylon erecting procedure has now been devised for cable stays lying in a single vertical plane or in a pair of spaced vertical planes.

SUMMARY OF THE INVENTION

It is therefore an object of the present invention to improve upon the bridge construction of the invention set forth in the aforementioned application, by the provision of simplified and highly effective transverse load carrying members between the box girder pairs, the box girders having sloping inner side slabs terminating at the inner edges of the deck slabs of the girders, such side slabs acting together with transverse load carrying frame members between the girder pairs for transferring the static and dynamic loads to a central location between the girder pairs.

Another object of the present invention is to improve upon the bridge construction set forth in the aforementioned application by providing hollow segmented pylons which are successively erected as the cable stays are successively draped over the tops of the segments, either single or pairs of cable stays being so draped depending on whether the cable stays lie in single or double vertical planes.

Other objects, advantages and novel features of the invention will become more apparent from the following detailed description of the invention when taken in conjunction with the accompanying drawings.

DETAILED DESCRIPTION OF THE INVENTION

Figure 1:
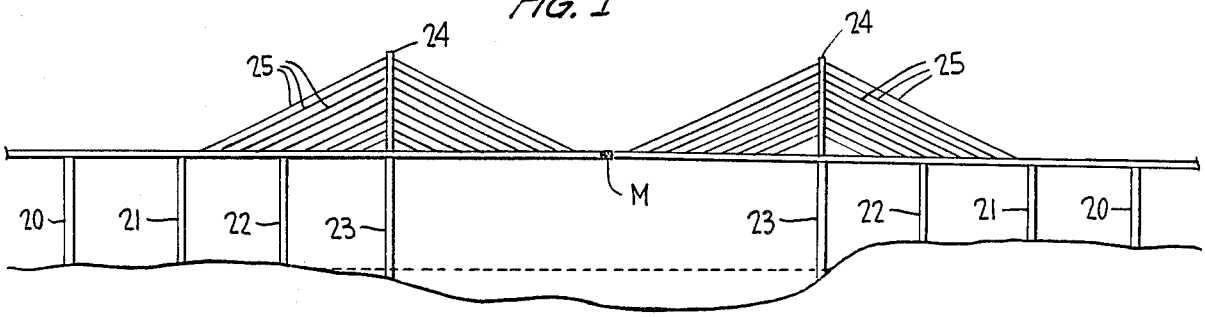
FIG. 1 is a schematic illustration of a completed bridge constructed according to the invention.
Figure 2:
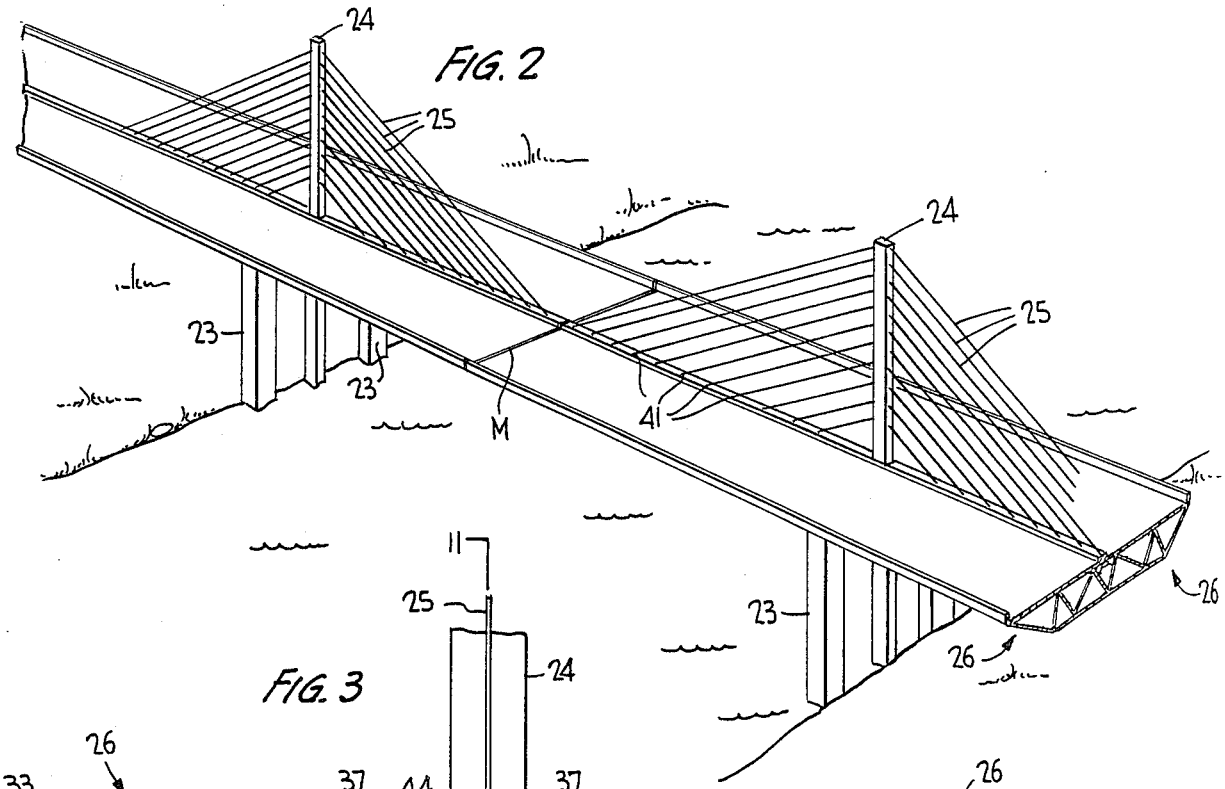
FIG. 2 is a perspective view of the main span and adjoining approach spans of a cable stayed box girder bridge according to the invention.

Turning now to the drawings wherein like reference characters refer to like and corresponding parts throughout the several views, FIG. 1 shows a cable stayed segmental, two-wide, hollow box girder bridge having several approach spans leading away from ground abutments (not shown), and an intervening main span. The approach spans are defined between concrete piers 20, 21, 22, 23, transversely spaced pairs of these piers such as 23 shown in FIG. 2 being provided for supporting pairs of concrete box girders side-by-side. Concrete pylons 24 are located centrally between pier pairs 23, from which cable stays 25 are hung for the support of the main span box girders.

Figure 3:
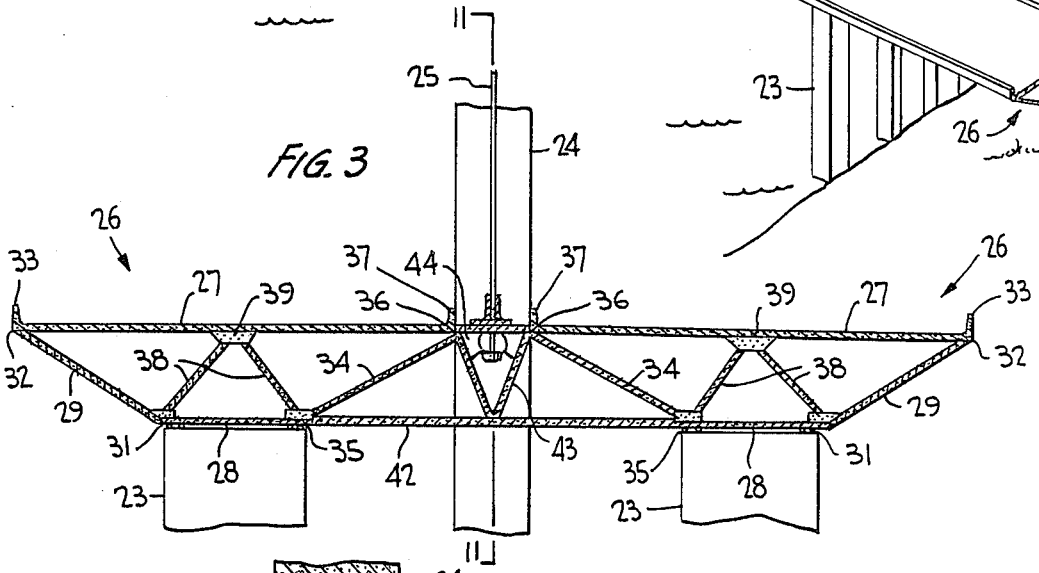
FIG. 3 is a sectional view of the twin box girders of FIG. 2 transversely interconnected.

Each of the approach spans is constructed completely between its piers, in succession, of side-by-side pairs of precast concrete hollow box girders 26, as typically shown in FIG. 3, and in accordance with that described in the aforementioned application, until main span pylons 24 are reached. The main span is then constructed starting from the pylons until the mid span M of the main span is reached, by cantilevering side-by-side pairs of box girders 26 successively to each other, generally as described in the aforementioned application. The adjoining box girders at the mid span are then joined together in some manner to complete the bridge, the cable stays being installed during bridge construction and likewise as described in the aforementioned application.

Each concrete box girder 26, in accordance with one embodiment, comprises an upper deck slab 27, and a bottom slab 28 resting on the underlying pier, the bottom slab having a reduced width compared to that of the deck slab. An outer side slab 29 extends from an outer edge 31 of the bottom slab outwardly and upwardly to an outer edge 32 of the deck slab at which an upwardly extending crash barrier 33 may be located. Similarly, an inner side slab 34 extends from an inner edge 35 of the bottom slab upwardly and inwardly to an inner edge 36 of the deck slab at which a crash barrier 37 may be located. The slope of each inner side slab 34 is preferably not greater than 1:2 relative to the horizontal.

Figure 11:
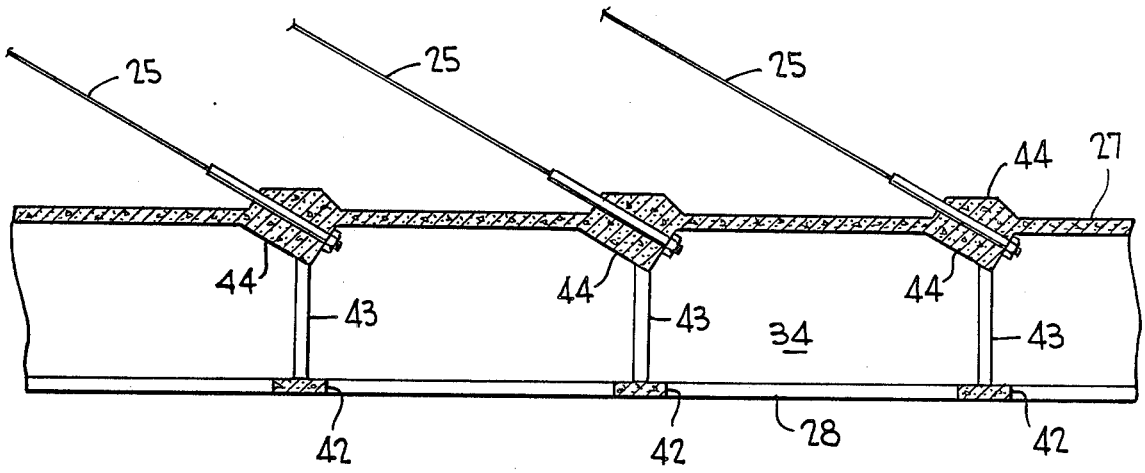
FIG. 11 is a sectional view taken substantially along the line 11—11 of FIG. 3, FIG. 11 being simplified showing only the essential features.

Internal support struts 38 are connected at edges 31 and 35 of the bottom slab and are joined together at their upper ends to the deck slab as at 39. These struts of the girder pairs, as shown in FIG. 3, are located in a common transverse vertical plane at at least those locations such as 41 (FIG. 2) at which the cable stays are anchored to the bridge deck. And, at at least such locations 41, transverse load carrying frame members are provided, each comprising a lower chord 42 extending between inner edges 35 of the bottom slabs, and a substantially V-shaped central section 43 (see also FIG. 11) connected to the bottom chord with the upper ends connected to inner edges 36 of the deck slabs of the pair. An anchor block 44 may be provided at the upper end of the V-shaped central section for anchoring the end of each cable stay 25 in place to the deck.

Inner side slabs 34 define, together with frame members 42, 43, a means for transferring static and dynamic loads of the girder pairs to the central location between the girder pairs at which the deck is supported by the cable stays. Inner struts 38 may assist in the transfer of such loads. Thus, it can be seen that inner side slabs 34 of the box girders function as structural members for transferring the loads to the central location of the box girder pairs at which the cable stays are supported, without the need for additional frame members as before. These inner side slabs may form a delta frame together with members 42 and 43, or may form other types of frames depending on the configuration of the interconnecting frame elements 42, 43.

Figure 6:
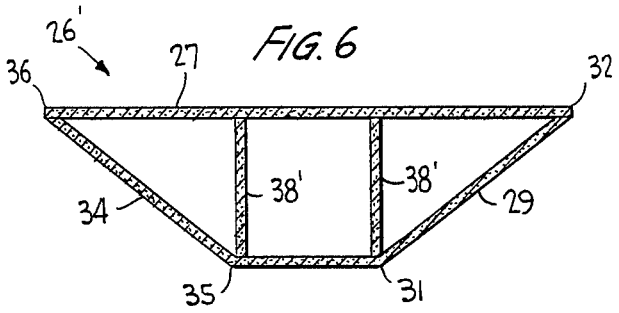
FIG. 6 is a sectional view of a box girder of another embodiment according to the invention.

Alternatively, box girders 26' (FIG. 6) may be constructed as having internal struts 38' extending perpendicular to deck slab 27 from edges 31 and 35 of the lower slab.

Figure 4:
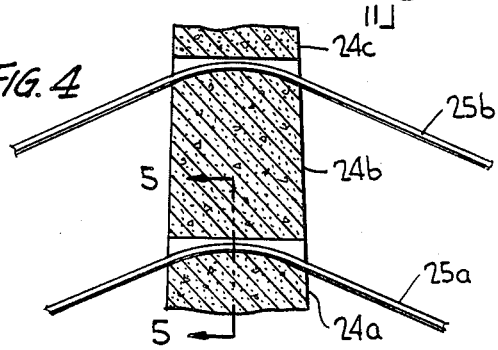
FIG. 4 is a detailed sectional view of the process of erecting a segmented pylon.
Figure 5:
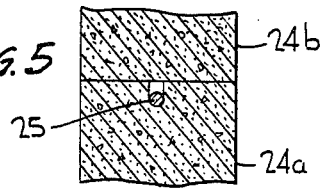
FIG. 5 is a sectional view taken substantially along the line 5—5 of FIG. 4.

During the process of constructing the main span, each bridge pylon 24 may be assembled in segments while cable stays 25 are being installed, essentially as described in the aforementioned application. Thus, cable stays **25*a*, 25*b*, etc. are draped successively over the tops of the pylon segments as they are placed one on top of the other in succession, as generally shown in FIGS. 4 and 5**.

Figure 7:
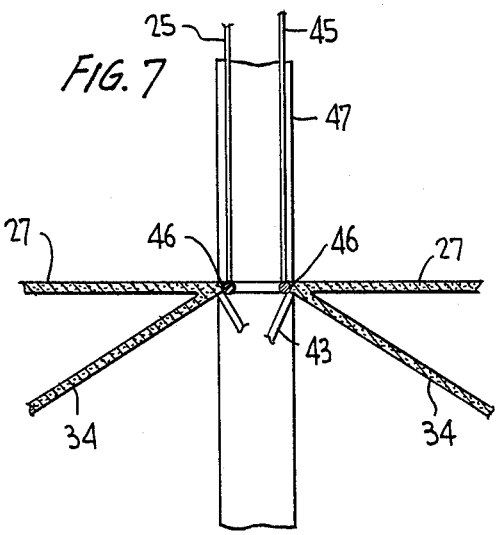
FIG. 7 is a view similar to FIG. 3 showing anchored cable stays lying in a pair of spaced vertical planes, the girder pair being shown in part.
Figure 9:
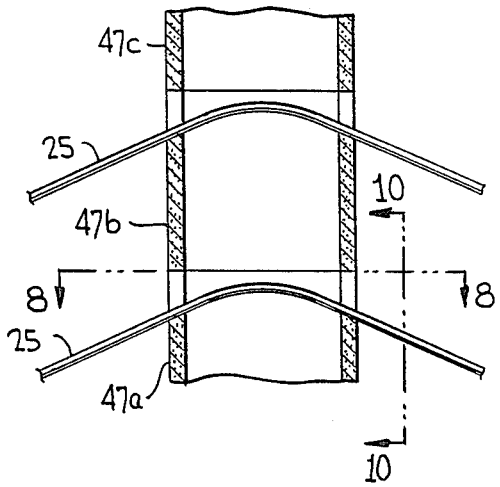
FIG. 9 is a sectional view of the hollow, segmented pylon taken substantially along the line 9—9 of FIG. 8.
Figure 8:
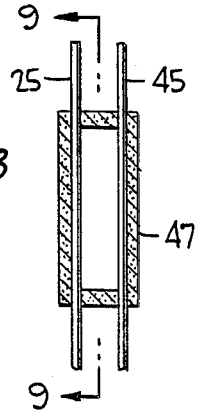
FIG. 8 is a view taken at the top of a typical pylon segment of a hollow pylon, substantially along the line 8—8 of FIG. 9.
Figure 10:
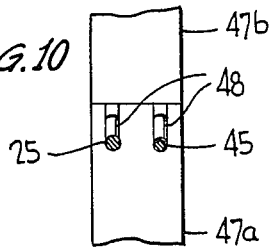
FIG. 10 is a side view across pair of pylon segments, taken substantially along the line 10—10 of FIG. 9.

Alternatively, cable stays lying in a pair of spaced vertical planes may be employed for supporting the main span from the pylons and anchored to the central sections between the box girder pairs. The single or double cable stays may be installed from segmented or from continuous pylons, which may be solid as shown in FIGS. 4 and 5 or which may be hollow as shown in FIGS. 8–10. Cable stays 25 and 45 are shown in FIG. 7 as lying in a pair of spaced vertical planes and anchored as at 46 in some normal manner to inner ends of the box girders and/or to section 43 of the frame work employed in interconnecting the box girder pairs together.

Each bridge pylon 47 may be of a hollow construction and of rectangular shape, as shown, although other polygonal shapes, as well as circular, may be employed for the pylons (whether hollow or solid) without departing from the invention. As shown in FIG. 8, cable stays 25 and 45 hug the opposing side walls of the pylon segments **47*a*, 47*b*, 47*c* as the cable stay pairs are draped over the tops of the pylon segments and are received within spaced grooves 48** therein. Otherwise, the assembly approach of the segmented hollow pylons is the same as described for that of the solid pylons.

Obviously, many modifications and variations of the present invention are made possible in the light of the above teachings. It is therefore to be understood that within the scope of the appended claims the invention may be practiced otherwise than as specifically described.

What is claimed is:

1. A method of constructing a two-wide segmental cable stayed bridge from like precast concrete bridge girders of a predetermined depth and of trapezoidal shape in cross-section connected side-to-side and end-to-end, the bridge having a main span of a predetermined length and a plurality of approach spans at opposite ends of said main span, each of said approach spans having a spacing substantially less than said predetermined length of said main span, the method comprising the steps of:

(A) assembling together each of said girders by providing a pair of spaced, parallel upper deck and bottom slabs, said deck slab being wider than said bottom slab, extending upwardly and outwardly sloping inner and outer side slabs betweens said deck and bottom slabs, and interconnecting said side slabs respectively to inner and outer edges of said deck and bottom slabs;

(B) constructing each of said approach spans toward said opposite ends of said main span, said constructing step for each of said approach spans being carried out before constructing said main span and comprising:

(a) assembling pairs of said girders side-by-side and end-to-end entirely between a first pair of transversely spaced apart piers and a second pair of transversely spaced apart piers longitudinally spaced from said first pair and defining one of said approach spans, said assembling being carried out from said second pair toward said first pair, and said second pair being located closer to said main span compared to the distance of said first pair therefrom;

(b) connecting a first pair of said box girders to each other at said inner edges thereof and to said second pair of piers;

(c) connecting remaining pairs of said girders to each other at said inner edges thereof and to adjoining ends of adjacent pairs;

(d) repeating said steps (a), (b) and (c) for further approach spans until said main span is reached, a pair of longitudinally spaced permanent pylons defining said main span;

(C) thereafter, from the last of said approach spans adjacent said main span, constructing said main span by (aa) cantilevering further pairs of precast concrete box girders, assembled together as in step (A), successively to each other, as a continuation of said last approach span, from said pylons toward one another until the midpoint between said pylons is reached;

(bb) connecting said girders of said further pairs respectively to each other at said inner edges thereof and at adjoining ends of adjacent pairs thereof;

(cc) during steps (aa) and (bb), supporting said main span from each of said pylons by extending a plurality of permanent cable stays, lying in at least one vertical plane, from each of said pylons to designated ones of said cantilevered girders and to designated ones of said girders of each of said last approach spans;

(dd) anchoring said cable stays to said designated ones at said girders at respective locations between said connected inner edges thereof; and (ee) at only said respective locations, connecting transverse load carrying members of said predetermined depth between said inner said slabs of said girder pairs and internally of said girder pairs between said deck and bottom slabs thereof, said members between said inner side slabs providing anchor means for said cable stays and, together with said members internally of said girder pairs as well as said inner side slabs of said girder pairs, transferring static and dynamic loads of said main span and of said last approach spans to said plane of support at said cable stays.

2. The method according to claim 1, comprising the further step of erecting each of said pylons from pylon segments during said supporting step (cc) by draping a first of said cable stays over the top of a first pylon segment, placing a second pylon segment over said draped cable stay, draping a second of said cable stays over said second segment, and repeating said placing and draping steps for the remaining cable stays and pylon segments.

3. The method according to claim 1, wherein said connecting step (ee) includes interconnecting together upper ends of said members internally of said girder pairs.

4. The method according to claim 1, wherein said connecting step (ee) includes extending said memberss internally of said girder pairs perpendicularly to said deck slabs.

5. The method according to claim 1, wherein said supporting step (cc) includes locating said permanent cable stays in a pair of spaced vertical planes.

6. The method according to claim 5, comprising the further step of erecting each of said pylons from hollow pylon segments during said supporting step (cc) by draping a first pair of said cable stays over the top of a first hollow pylon segment, placing a second hollow pylon segment over said draped cable stay, draping a second pair of said cable stays over said second segment, and repeating said placing and draping steps for the remaining cable stays and pylon segments.

7. The method according to claim 1, wherein said connecting step (ee) includes providing structural elements which define delta frames together with said inner side slabs acting as transverse load carrying members between said inner side slabs.

8. The method according to claim 7, wherein said connecting step (ee) further includes providing a lower chord as part of each said delta frame between said inner side slabs, providing on said lower chord a central, upwardly opening, V-shaped section which includes said anchor means, and providing struts internally of said girder pairs.

* * * * *